US005996455A

United States Patent [19]

Haag et al.

[11] Patent Number: 5,996,455

[45] Date of Patent: Dec. 7, 1999

[54] METHOD AND DEVICE FOR MAKING HOLES AT THE CIRCUMFERENCE OF A HOLLOW SHAPE

[75] Inventors: Ulrich Haag, Hamburg; Uwe Hardtke, Neu Wulmstorf; Thomas Hülsberg, Rosengarten, all of Germany

[73] Assignee: DaimlerChrysler AG, Stuttgart, Germany

[21] Appl. No.: 08/974,758

[22] Filed: Nov. 20, 1997

[30] Foreign Application Priority Data

Nov. 20, 1996 [DE] Germany ..... 196 47 962

[51] Int. Cl.[6] ..... B21D 26/02; B21D 28/18

[52] U.S. Cl. ..... 83/54; 72/55; 83/25; 83/188

[58] Field of Search ..... 72/55, 370.22; 225/2, 94, 96, 100; 83/24, 25, 188, 191, 684, 54

[56] References Cited

U.S. PATENT DOCUMENTS

| | | | |
|---|---|---|---|
| 3,022,811 | 2/1962 | Huet | 83/188 X |
| 3,234,838 | 2/1966 | Faull | 83/54 X |
| 3,416,211 | 12/1968 | Ahlman | 83/54 X |
| 3,487,668 | 1/1970 | Fuchs, Jr. | 72/55 |
| 3,489,045 | 1/1970 | Ray, Sr. | 83/188 |
| 4,930,384 | 6/1990 | Nakatsuji | 83/54 X |
| 4,989,482 | 2/1991 | Mason | 83/22 |
| 5,460,026 | 10/1995 | Schafer | 72/55 X |
| 5,709,139 | 1/1998 | Shimizu et al. | 83/54 X |
| 5,765,420 | 6/1998 | Schaefer | 72/55 X |

FOREIGN PATENT DOCUMENTS

| | | | |
|---|---|---|---|
| 199463 | 9/1958 | Austria | 72/55 |
| 0 484 789 | 5/1992 | European Pat. Off. | 72/55 |
| 2369029 | 6/1978 | France | 83/54 |
| 40 35 625 | 5/1992 | Germany | 83/54 |
| 958531 | 5/1964 | United Kingdom | 83/54 |
| 1166532 | 10/1969 | United Kingdom | 83/54 |

*Primary Examiner*—M. Rachuba
*Attorney, Agent, or Firm*—Evenson, McKeown, Edwards & Lenahan, P.L.L.C.

[57] ABSTRACT

A method and a device for producing holes in the circumference of a hollow shape, with a wall piece being separated as a slug from the hollow shape in an internal high-pressure mold and being jammed without projecting relative to the outer circumference of the hollow shape in a previously produced hole. In order to remove the slug produced during punching in simple fashion from the internal high-pressure mold, the separated slug is jammed at a fluid pressure that is reduced relative to an internal high fluid pressure without loss via a punch and can separate the slug following removal of the finished hollow shape from the internal high-pressure mold, from the hollow shape, finally clearing the hole.

19 Claims, 5 Drawing Sheets

METHOD AND DEVICE FOR MAKING HOLES AT THE CIRCUMFERENCE OF A HOLLOW SHAPE

BACKGROUND AND SUMMARY OF THE INVENTION

This application claims the priority of German application 196 47 962.2, the disclosure of which is expressly incorporated by reference herein.

The invention relates to a method for making holes at the circumference of a hollow shape and a device for this purpose.

A method and a device for making holes at the circumference of a hollow shape are known from U.S. Pat. No. 4,989,482. Following a shaping process involving internal high-pressure shaping at an internal pressure in the range of approximately 7 to 700 bars, a hole is produced in the circumference of a hollow shape still in the mold by guiding a punch against the wall of the hollow shape from the outside, said wall being pressed into the interior of the hollow shape by the flush application of the punch. The punch has a channel that connects its face adjacent the hollow shape and is provided with a cavity communicated with the atmosphere. As a result, a pressure differential develops between the end of the punch in the vicinity of the cavity and the interior of the hollow shape, said pressure differential pressing the hollow shape against the annular contact surface of the face of the punch that surrounds the cavity. During further indentation of the wall of the hollow shape, the limit of stretchability of the material of which the hollow shape is composed is reached, and when it is exceeded the wall of the hollow shape tears around the point of impact of the punch to form a slug. Because of the uneven wall of the hole that is produced, however, there is inadequate sealing of the space that is formed as the punch is advanced between the outside of the hollow shape and the female die guiding the punch, and there is no guidance of the punch by the female die relative to the interior of the hollow shape that is pressurized by a fluid, so that despite the radial application of the wall of the hole to the circumference of the punch, a pressure drop occurs within the hollow shape.

As a result, the pressure differential between the atmosphere and the interior at the hollow shape is so low that the suction exerted by the punch on the slug is canceled out, or at least is reduced to a significant degree. In the former case, the slug comes loose from the punch and drops into the interior of the hollow shape. In the latter case, the slug remains adhering with a low force to the end of the punch. During the return movement of the punch, the slug falls back into the hole. However, this occurs only partially since the wall of the hole, which is bent toward the interior of the hollow shape as a result of the return movement of the slug caused by the retraction of the punch, offers a resistance, so that because of the abovementioned low suction force, when the pressure equilibrium is established, the punch lifts away from the slug. In most cases, the slug immediately falls into the interior of the hollow shape without adhering to the wall of the hole. On the other hand, the slug can remain hanging in the hole, so that the clamping effect in the latter is small.

Contrary to the assertion made in the above-mentioned document, it is possible for pressure to build up inside the hollow shape following jamming of the slug, so that the bent wall of the hole is flattened, resulting in an additional clamping of the slug in the hole. No pressure can develop under these conditions because there is no match between the shapes of the wall of the hole and of the slug in the jammed position in which the slug projects into the interior of the hollow shape. This rules out a position of the slug against the wall of the hole that can provide an effective seal against high pressure. Because of the vibrations of the hollow shape that occur as the hollow shape is removed from the internal high-pressure mold, the slug comes loose from its unstable jammed position and drops into the hollow shape. Since the interior of the hollow shape still has a wet film on it despite the fact that the high-pressure fluid has been removed, the slug slides out of the hollow shape when the latter is removed and drops into the mold. Separate removal of the slug from the mold is very awkward, and a slug that has been "forgotten" and is left in the mold can cause irreparable damage to the mold during subsequent shaping processes.

A goal of the invention is to improve a method and a device for making holes at the circumference of a hollow shape such that the slug produced during perforation can be removed in simple fashion from the internal high-pressure mold.

This and other goals have been achieved according to the present invention by providing a method for producing holes at the circumference of a hollow shape, with a wall portion being separated as a slug from a hollow shape within a mold that uses internal high pressure and can be jammed in a previously formed hole without projecting with respect to the outer circumference of the hollow shape, characterized in that the jamming of separated slug with a high fluid pressure that is relaxed relative to a high internal fluid pressure and secured against loss takes place by means of a punch and in that slug, following removal of finished hollow shape from internal high pressure mold, is separated from hollow shape when hole is finally cleared.

This and other goals have been achieved according to the present invention by providing a device for making holes at the circumference of a hollow shape, with a punch integrated into an internal high-pressure mold, by means of which a punched portion of the wall can be separated as a slug from the hollow shape with preliminary production of a hole, and with a return means by means of which the separated slug can be jammed in a hole, and is then jammed in a previously prepared hole without projecting relative to the outer circumference of the hollow shape, characterized in that the return means is a punch with which slug, without fear of loss, in a pressure state that is less than an internal high pressure that is used for internal high-pressure shaping, can be forced inside hollow shape into previously produced hole and in that the device incorporates a means for removing slug following removal of finished hollow shape from internal high-pressure mold, by which hole is finally produced.

According to the invention, the slug can be jammed without the aid of internal high pressure produced by a fluid in a previously produced hole in such fashion that the hollow shape can be removed from the internal high-pressure mold without the slug falling out of the hole in the process. This eliminates the expense of cleaning slugs out of the mold. In addition, there is no need to develop a high fluid pressure or to provide the apparatus associated therewith for pushing the slug back into the hole, and high-pressure-resistant seals can be eliminated as well. Because of the lack of any projection of the slug in the hole above the exterior of the hollow shape, the hollow shape can also simply be removed from the mold. In addition, problems with recovering the slug as far as process engineering is concerned, involving a pressure drop after the hole is made, are overcome. The jammed slug is removed in simple fashion after the hollow shape has been removed from the mold, with the slug not causing any damage or cleanup cost because of its external removal. Because the slug is firmly jammed, perforation at the circumference of the hollow shape is possible at all angles relative to the axial position of the hollow shape inside the mold, without there being any danger, after the pressure is released following production of the hole, of the slug dropping into the hollow shape or, upon removal of the hollow shape, falling into the mold from the inside to the outside after the hollow shape has been removed.

Other objects, advantages and novel features of the present invention will become apparent from the following detailed description of the invention when considered in conjunction with the accompanying drawings.

DETAILED DESCRIPTION OF THE DRAWINGS

Figure 1:
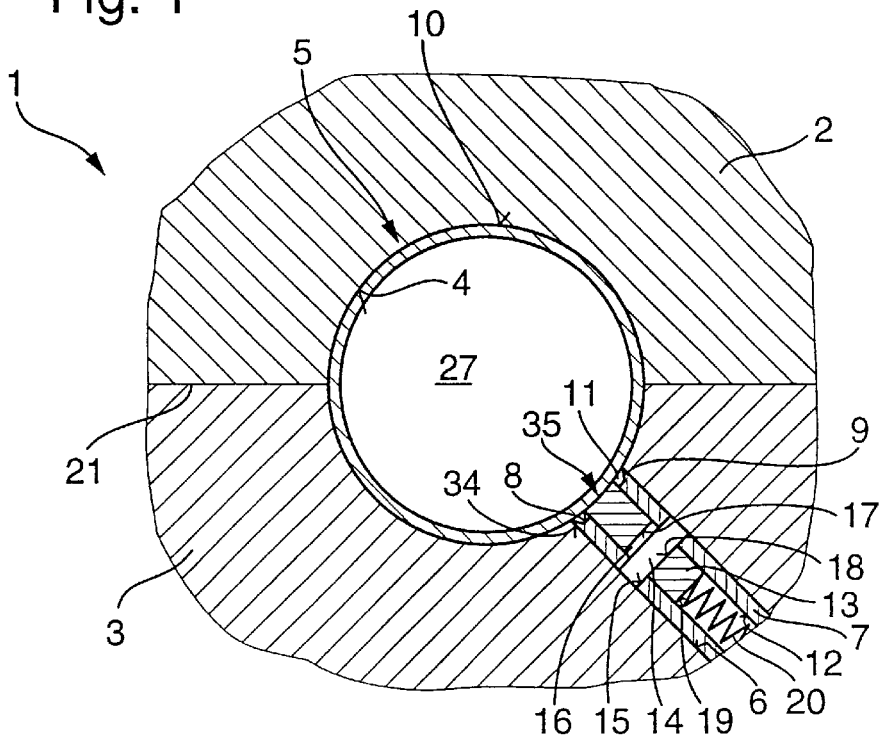
FIG. 1 shows a cross section of the internal high-pressure mold of the device according to a preferred embodiment of the present invention in the zero-pressure state before the processing of the hollow shape placed in the impression of the mold, and a punch provided with an annular blade, integrated into the mold and shown in the standby position.

FIG. 1 shows a two-piece internal high-pressure mold 1, composed of an upper tool 2 and a lower tool 3, that form the two halves of mold 1. Parting plane 21 of upper and lower tools 2 and 3 is aligned horizontally. Impression 4 formed by the upper and lower tools 2 and 3 contains a tubular hollow shape 5 with a circular cross section. However, other cross-sectional geometries of hollow shape 5 and matching shapes of impression 4 are possible. In addition, hollow shape 5 can be bent once or several times over its length. A precision-machined guide bore 6 is made at an angle of approximately 45 degrees to the axis of the hollow shape in lower tool 3, said bore being aligned radially with respect to impression 4 and terminating in the latter. A cutting punch 7 is displaceably guided in guide bore 6. Cutting punch 7 abuts the wall of guide bore 6 with limited play, with said bore and/or the circumference of the punch being provided with a coating to protect against wear or to avoid wear and to reduce friction between the two friction partners, punch 7 and the guide bore wall, said coating improving the sliding properties of punch 7 in guide bore 6. Guide bore 6 can also lie at different angles to the axis of the hollow shape and need not necessarily be aligned radially. However, radial alignment is favorable for simple design of punch 7 for a tubular hollow shape 5.

Punch 7 is made cylindrical, with a circular cross section. At its end facing impression 4, punch 7 has an annular cutter 9 flush with exterior 34 at the circumference of punch 7, said cutter, in the standby position of punch 7 shown in FIG. 1, abutting exterior 10 of hollow shape 5 throughout and thus fitting flush against impression 4 all the way around. Annular cutter 9 delimits a cavity 11 whose bottom is formed by end 8. Cavity 11 and simultaneously end 8 as well have a concave shape and depth such that the portion of the wall of hollow shape 5 that is later impacted by punch 7 can be accepted almost completely as slug 26.

Punch 7 has an axial bore 12 in which a plunger in the shape of a punch 13 is guided with limited play. Plunger 13 is secured by a retaining pin 14, said pin being pressed into transverse bore 15 of punch 7. To permit displacement, plunger 13 has an elongate hole 16 that runs axially, the ends 17, 18 of said hole forming the stops on retaining pin 14. Plunger 13 is supported at rear end 19 by a compression spring 20 or is urged by said spring toward impression 4. The support as well as the drive of plunger 13 however can also be performed hydraulically, pneumatically, or mechanically by a slide member. Plunger 13 likewise has its end 35 against hollow shape 5 when punch 7 is in the standby position, with end 18 of elongate hole 16 abutting retaining pin 14. At this stage, a pressure prevails in hollow shape 5, preferably made of metal, said pressure being less than a pressure that would expand hollow shape 5 outward, atmospheric pressure for example.

Figure 2:
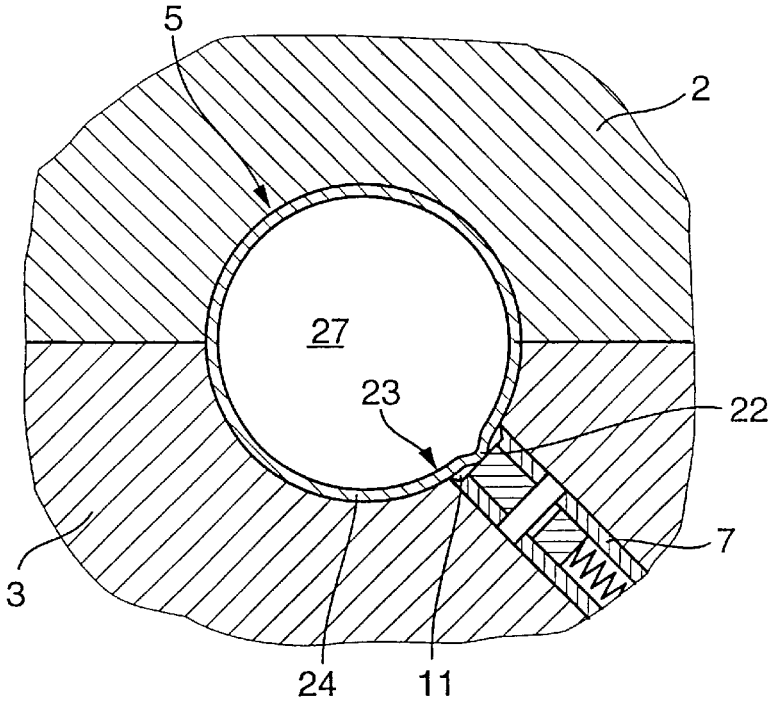
FIG. 2 shows the mold and the punch of the device in FIG. 1 in the state of the mold in which it is subjected to a shaping pressure.

If the pressure is raised to a shaping pressure of approximately 2000 bars, hollow shape 5 begins to expand into cavity 11 of punch 7 which is still in the standby position (FIG. 2). Plunger 13 is displaced toward its other stop, in other words so that it abuts its elongate hole in 17 at retaining pin 14 against the force of compression spring 20, which makes the transition to a pretensioned state. Plunger 13 operates as a sort of pressure pad, as is also known from the formation of tees (i.e. T-shaped branched pipes) by internal high-pressure shaping. A dent 22 is formed in hollow shape 5, whereby, as the material of the hollow shape flows into cavity 11, the material in marginal area 23 of guide bore 6 at the transition to impression 4 is thinned, pulling the material across the edge of the guide bore. Face 35 of plunger 13 in its standby position together with end 8 of punch 7 forms the bottom of cavity 11 in which expansion takes place.

Figure 3:
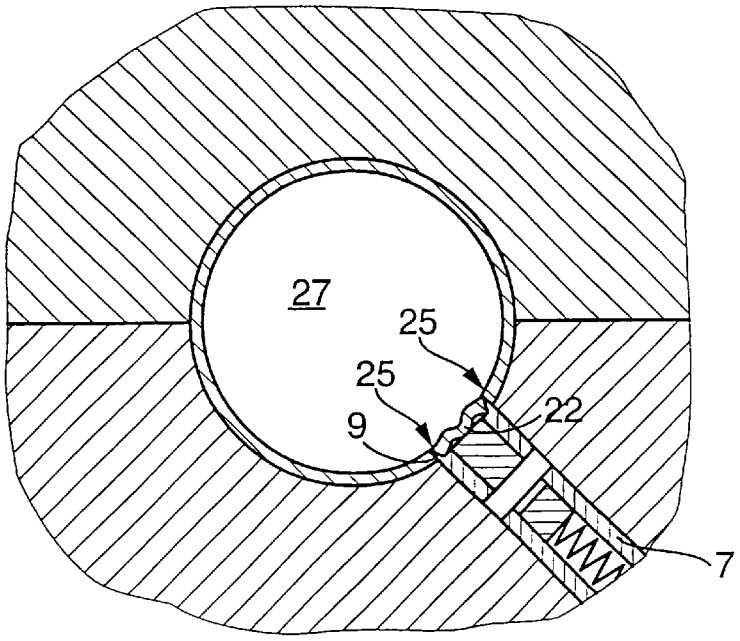
FIG. 3 shows the mold and the punch of the device shown in FIG. 1 in the operating position of the punch in the state of the mold in which it is subjected to a shaping pressure.

Then punch 7 is displaced toward impression 4 against the internal high pressure, which is still high, by means of a hydraulic system that generates high pressure and acts as a drive means until annular cutter 9 cuts into wall 24 of the hollow shape, making a plunge cut. Cutting causes a thin spot 25 to form in wall 24 of the hollow shape, whereby at the same time dent 22 of future slug 26 is pushed backward (FIG. 3) by the movement of the punch in the approximate direction of interior space 27 of hollow shape 5. The production of thin spot 25 is supported by the above thinning of the hollow-shape material in marginal area 23 by the expansion of hollow shape 5, with the plunge cut then being made with a lesser depth of penetration than a plunge cut without previous thinning. Annular cutter 9 is also protected somewhat as far as wear caused by abrasion is concerned. The internal high pressure avoids a situation in which when punch 7 is used to make a plunge cut, the hollow-shape wall 24, in the area that laterally abuts hole 29 to be produced, is bent around toward interior 27 of the hollow shape and thus deforms the uniform pattern of exterior 10 of hollow shape 5.

Following production of thin spot 25, punch 7 is retracted suddenly or abruptly into the standby position, whereupon thin spot 25 tears all the way around. The wall thickness of thin spot 25 is dimensioned in such fashion or is sufficiently unstable that slug 26 is torn out simply by the force of the internal high pressure from wall 24 of the hollow shape. Because of the clean cut made by annular cutter 9, wall 28 of the resultant hole 29 is flat and sharp-edged at the point where it joins exterior 10 of hollow shape 5. Exterior 10 remains undistorted by the internal pressure, which is constant at the impression until the hole is formed, even in the vicinity of hole wall 28, so that the shape of hollow shape 5 is preserved after perforation. As a result of the sudden retraction of punch 7, the inertia of slug 26 which is still in wall 24 of the hollow shape and the vacuum briefly created between exterior 10 of hollow shape 5 and punch 7 are advantageously utilized for tearing, so that the resultant increase in the pressure differential between interior 27 of the hollow shape and the space of slug 26 formed by exterior 10 of hollow shape 5 and punch 7 causes slug 26 to be likewise torn free abruptly even more easily from wall 24 of the hollow shape without contact with punch 7.

To produce several holes 29 by punching out slugs 26 from the inside to the outside, the familiar problem generally arises that when separating a first slug 26, because of the fact that complete sealing from high pressure cannot be achieved completely externally, a strong pressure drop occurs, so that the remaining holes can be produced only inadequately if at all, with hole dimensions that are inexact in size, and with deformations of hollow section 5 in the marginal area of holes 29 in the form of plastic indentations. This occurs in particular when holes 29 to be produced have different cross-sectional areas, with hole 29 with the comparatively largest cross-sectional area being the first made because of the greater shearing force of the internal high pressure acting on wall 24 of the hollow shape. In order to avoid this or at least to reduce the harmful consequences for further accurate hole production in internal high-pressure mold 1, according to the invention and in an advantageous manner, the depth of penetration of punch 7 with its annular cutter 9 into wall 24 of the hollow shape is determined individually for each subsequent hole 29, so that, for production following the penetration of the punch, a thin spot 25 is formed in the cross-sectional area of the hole 29 in question. Wall 24 of hollow shape 5, to make a hole 29 with a smaller cross-sectional area, is weakened to a greater degree than for making a hole 29 with a larger cross-sectional area. This setting or adjustment is designed so that holes 29 are created practically simultaneously.

Figure 4:
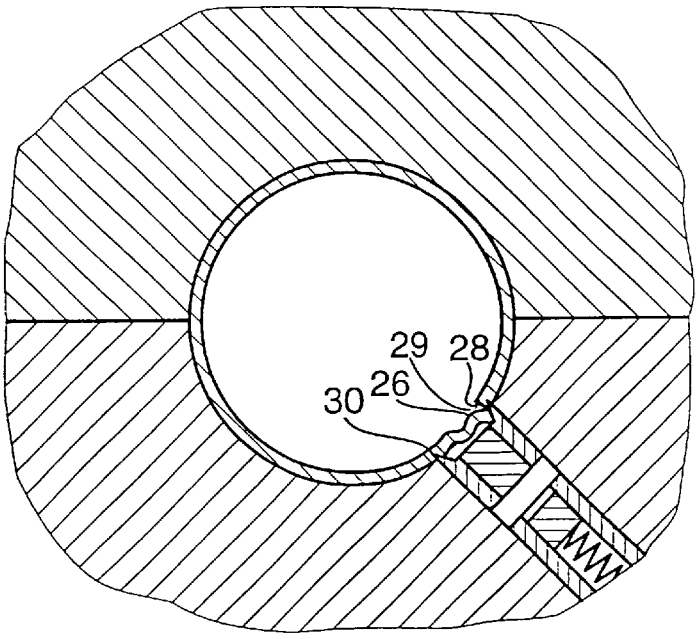
FIG. 4 shows the mold and the punch of the device shown in FIG. 1 following processing of the hollow shape.

If, in the case of certain holes 29, removal of slug 26 does not take place completely, these slugs hang by a thin wall thread 30 (FIG. 4) which can be clipped later following removal of punched hollow shape 5 from mold 1. Thus, the burr that may result is of little importance for the finished quality of hollow section 5, since the burr is not located in the vicinity of exterior 10 of hollow shape 5 as a result of the previous plunge cut made by annular cutter 9 of punch 7.

According to the method of the invention, any hole geometry can be formed in simple fashion, whereby only punch 7 needs to be appropriately shaped at its end 8 and its guide bore 6 must be correspondingly shaped.

Punch 7, in the standby position, can be located in guide bore 6 in such fashion that slug 26 separated from wall 24 of the hollow shape can leave hollow shape 5 only partially. Slug 26 is then located in hole 29 for about 3/10 to 5/10 of the thickness of wall 24 of the hollow shape. The process for separating slug 26 from wall 24 of the hollow shape is thus completed. Then the internal high pressure inside hollow shape internal chamber 27 is preferably lowered to atmospheric pressure, whereupon plunger 13 is moved against slug 26. The slug is pushed back completely into hole 29 by plunger 13, so that projection of slug 26 beyond exterior 10 of hollow shape 5, which would prevent or interfere with removal of the finished hollow shape is avoided. Because of the resilience of the material of which perforated hollow shape 5 is made at hole wall 28, assurance is always provided that slug 26 will jam in hole 29. The partial expulsion of slug 26 by internal high pressure during perforation considerably facilitates repeated impression by plunger 13, since otherwise if slug 26 were to come completely free from wall 24 of the hollow shape caused by the pronounced radial material resilience of hole wall 28, because of the cross section of the hole being smaller by comparison to the cross section of the slug, pushing slug 26 into hole 29 would be very problematical. Of course it is also possible for slug 26 to be torn completely out of wall 24 of the hollow shape and for slug 26 to be pushed back again into hole 29 by plunger 13. However, as stated above, this is difficult because of the resilience of the material in the vicinity of wall 28 of the hole.

Figure 5:
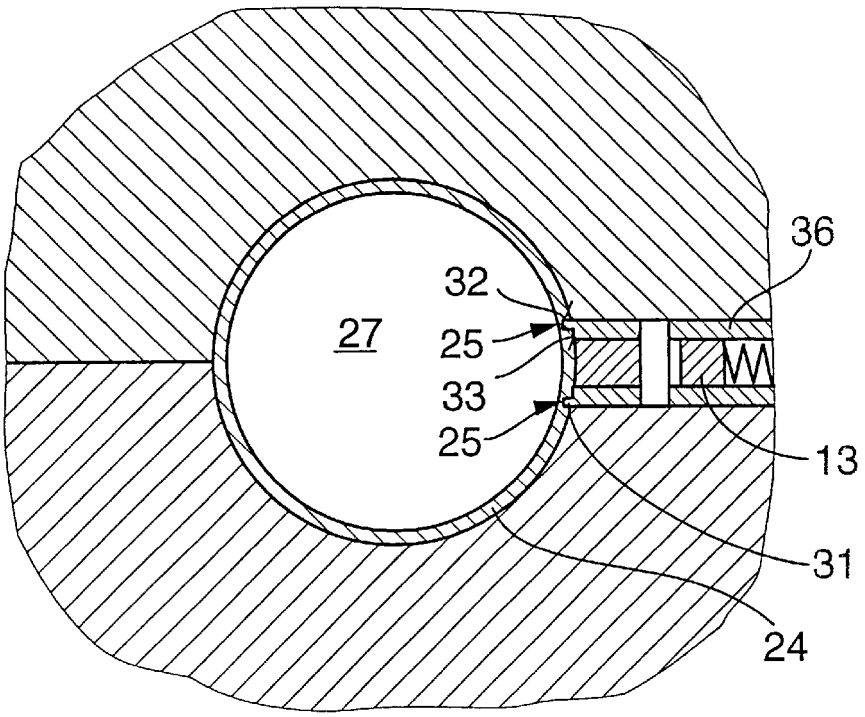
FIG. 5 shows a cross section of the internal high-pressure mold of the device according to the invention in the state in which it is subjected to pressure, with a hollow shape placed in the cavity, and a punch in its operating position, said punch having an annular wall capable of embossing and being integrated into the mold.

As an alternative to forming thin spots 25 according to FIGS. 1 to 4 by annular cutter 9, an embossing punch 36 can be used which at its end 8, instead of an annular cutter 9, has an annular wall 31 as a penetration means, said wall being rectangular in cross section and fitting flush at its exterior 32 with the circumference of the punch, as can be seen in FIG. 5. In this case, punch 36 is in the operating position in which, driven by a high-pressure-generating hydraulic system, it is forced by annular wall 31 into wall 24 of the hollow shape and as a result of the embossing action, produces a weakness in the wall that forms thin spot 25 and corresponds to the shape of wall 32.

During embossing, in contrast to the embodiment described above, in which wall 24 of the hollow shape is separated by plunge cutting using annular cutter 9 to make a cut, under the influence of internal high pressure, the material of wall 24 of the hollow shape is compressed. The compressed hollow-shape material flows into a cavity 33 formed in end 8 of punch 36 and delimited by annular wall 31. Cavity 33 in contrast to cavity 11 is filled completely by flowing hollow-shape material. This deliberate flow of material into a cavity 33 provided for the purpose allows formation of desired thin spot 25. This is not possible with a plane plate-shaped design for face 8 of the plunger, as can be seen in the document that constitutes the species.

Figure 6:
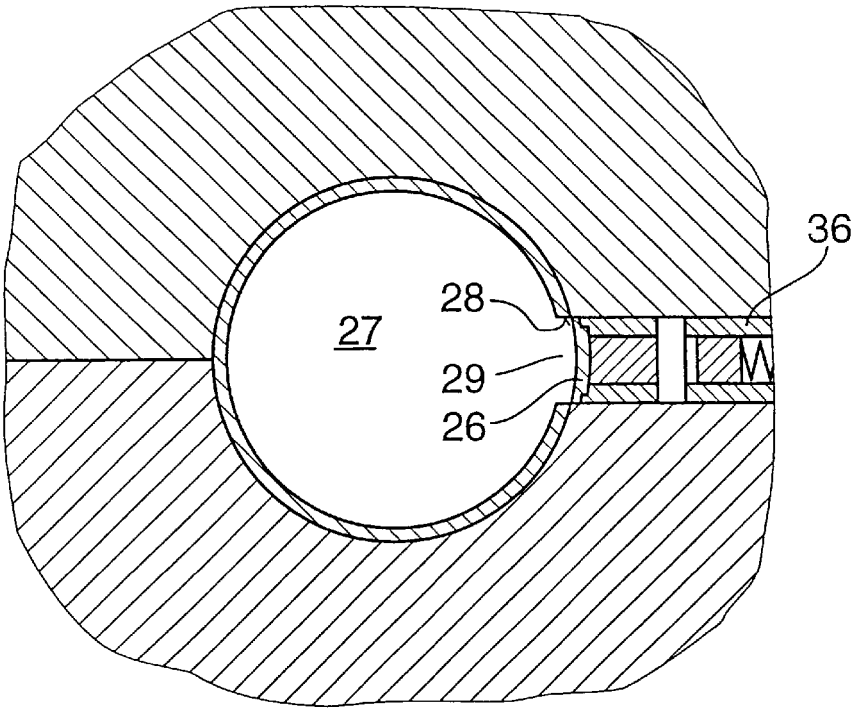
FIG. 6 shows the mold and the punch of FIG. 5 in the standby position of the punch following processing of the hollow shape.
Figure 7:
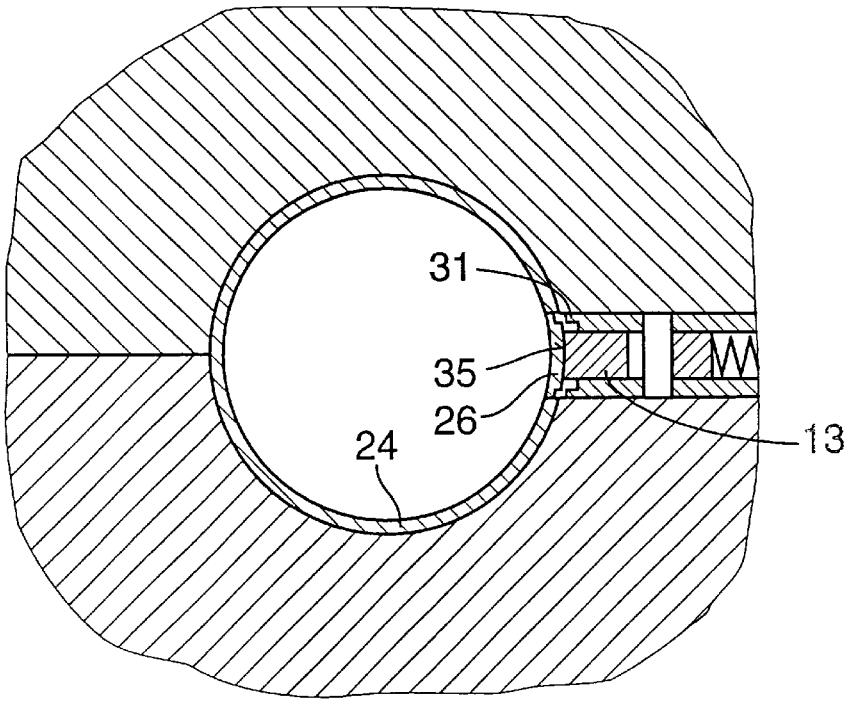
FIG. 7 shows the mold and the punch in FIG. 5 in the standby position of the punch following processing of the hollow shape, with the slug jammed in the hole in the zero-pressure state of the mold.
Figure 8:
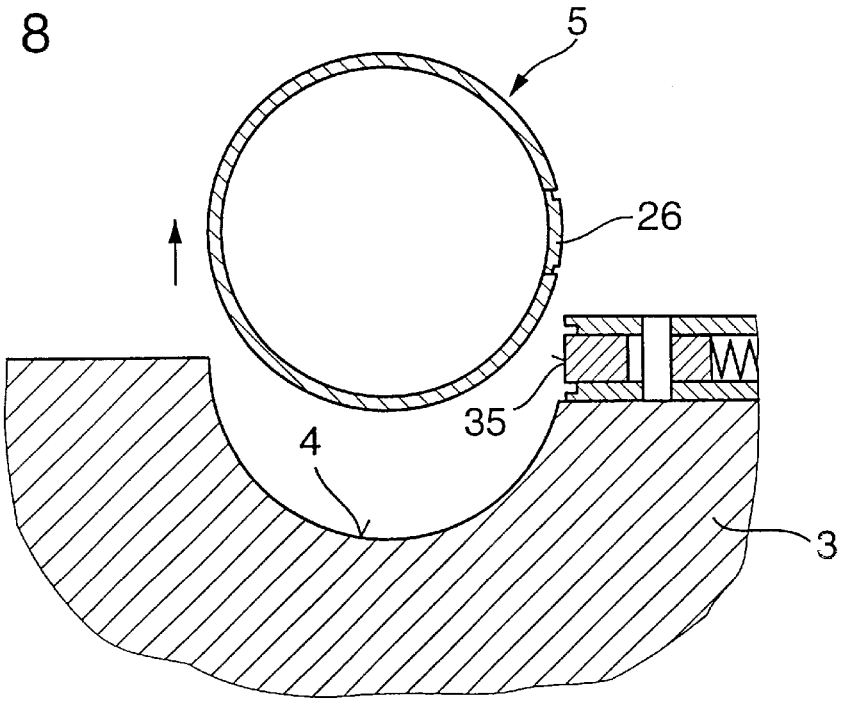
FIG. 8 shows the mold and punch from FIG. 5, with the mold in the open position, during the removal of the finished shape.

In correspondence with the first embodiment, upon embossing thin spot 25, a high pressure in the vicinity of approximately 2000 bars prevails in interior 27 of hollow shape 5. Likewise, at this pressure, prior to embossing, hollow shape 5 is expanded and extends into cavity 33. Following embossing, punch 36 is withdrawn in the same fashion, whereupon thin spot 25 tears all the way around (FIG. 6) and slug 26 is pressed out by the internal high pressure. Plunger 13, preferably at atmospheric pressure, forces slug 26 to remain in hole 29 which has a narrow circumferential section (FIG. 7). Following the jamming of slug 26 in hole 29, the pressure in interior 27 of hollow shape 5 is relaxed completely and mold 1 is then opened. In this case, opening takes place by lifting upper tool 2, after which finished hollow shape 5 can be removed. The perforation axis runs in parting plane 21 of upper and lower tools 2 and 3 (FIG. 8). To produce a plurality of holes 29, the same process is used as in the first embodiment, with a suitable modification.

Plunger 13 can be located separately from punch 7 or 36 and can be shifted into the operating position to perform its function. Similarly, it is also possible for the plunger function to be assumed by punches 7 and 36 themselves. As a result, one component, plunger 13, and its drive can be eliminated. This however is practical only if slug 26 has not jammed in cavity 11, 33 of punch 7, 36. Thus, the integration of plunger 13 into punch 7 or 36 for pushing slug 26 backward is not only a simple structural solution but also, apart from the improved economy of the method over the first possibility mentioned above, offers the functional advantage that plunger 13 releases any slugs 26 that become jammed in punch 7 or 36.

Holes 29 can be produced both in hollow shapes 5 manufactured in other tools and in hollow shapes 5 that are produced for the first time by internal high-pressure shaping from a hollow blank placed in mold 1 and then calibrated. Hollow shape 5 can consist of assembled, preferably welded half-shells or even extrusion-molded shapes.

In addition, as an alternative to the two previous embodiments, hollow shape 5, after being placed in mold 1, can be expanded by internal high pressure, which impacts punch 7 or 36 that is supported at the rear in impression 4 of mold 1, with thin spot 25 of wall 24 of the hollow shape being formed as a result of the penetration of punch 7, 36 into wall 24 of the hollow shape. Following completion of the widening process, punch 7 or 36 is retracted, whereupon thin spot 25 tears under the influence of internal high pressure, and resultant slug 26 is torn outward.

Slug 26, upon complete separation from wall 24 of the hollow shape, is pressed into cavity 11 or 33 of punch 7 or 36 within its guide bore 6 and jammed there. During the partial separation of slug 26, punch 7 or 36 provides sufficient support by its permanent contact with slug 26 so that the slug has no opportunity inadvertently to enter mold 1 or interior chamber 27 of hollow shape 5.

In all the embodiments shown, because of the embossing or cutting of wall 24 of the hollow shape following the tearing of thin spot 25 as a result of internal high pressure, an essentially uniformly smooth hole wall 28 is formed. This, because of the lack of resistance from macroscopic roughnesses, facilitates the pressing of slug 26 inward into hole 29. Apart from this, the formation of a score is very advantageous since slug 26 then tears locally at a defined location so that there is no undesired crack formation in the material of the hollow shape laterally with respect to the opening of guide bore 6. This could also take place in an uncontrolled manner. The resultant slug 26 with severe edge deformations would then be very difficult to jam into completely rough hole wall 28 with gaps by subsequent pushing backward by means of plunger 13.

Following preliminary production of holes 29 according to the above embodiments, mold 1 is opened at atmosphere pressure and hollow shape 5 is removed therefrom. Following removal of the hollow shape, slug 26 can be forced in conventional fashion out of hollow shape 5 with the aid of a simple device, without there being any deformations of hole shape 5 in the marginal area of hole 29.

Figure 9:
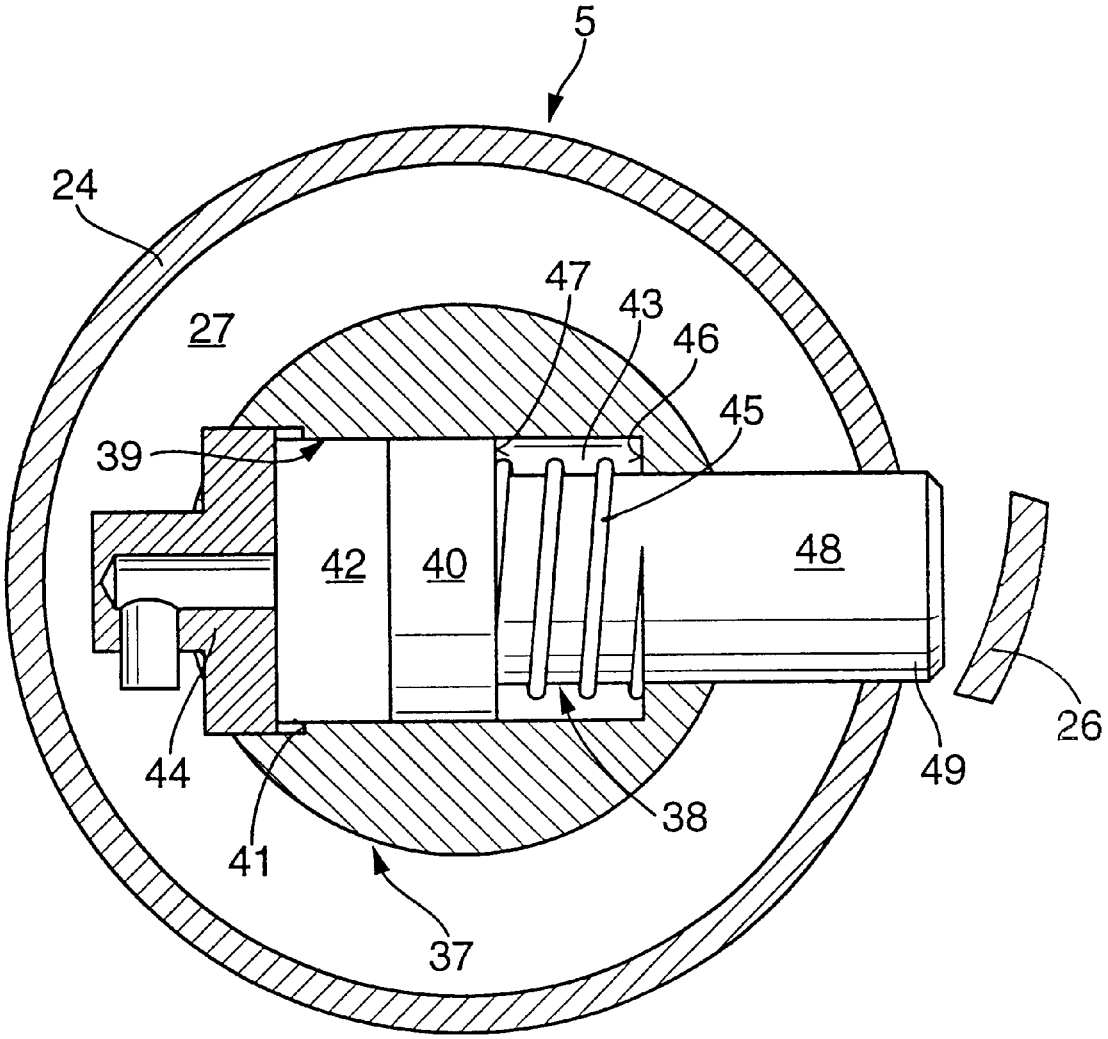
FIG. 9 shows a cross section through a device for releasing the slug following removal of the finished hollow shape from the mold.

The expulsion or release of slug 26 can take place for example in hollow shapes 5 with an essentially rectilinear shape with sufficiently large cross sections; one or more displaceable ejector punches 38 are located in a device 37 designed as a lance that can be inserted into hollow shape 5, said punches being guided for this purpose in transverse bores 39 of the lance (FIG. 9). The ejector punch 38 by its plate-shaped head 40 that abuts transverse bore wall 41 in a sealing fashion all the way around by its circumference, divides transverse bore 39 into two partial chambers 42, 43. Partial chamber 42 has a pressure connection 44, by means of which partial chamber 42 and hence head 40 of ejector punch 38 can be charged with compressed air or a compression fluid. When a pressure is exerted, injector punch 38 is displaced in the direction of wall 46 against the force of a compression spring 45, which in partial chamber 43 on the one hand abuts end wall 46 therein of transverse bore 39 that tapers in steps and on the other hand abuts underside 47 of the head facing away from partial chamber 42. With exact positioning of the lance with respect to hollow shape 5, as a result of the displacement of punch shaft 48 with its free end 49 pointing toward hollow shape 5, impacts slug 26 jammed in hollow profile wall 24, whereupon during further displacement of shaft 48, slug 26 is forced out of wall 24 of the hollow shape. Transverse bore 39 is closed off in a sealing fashion from the side of partial chamber 42 opposite punch head 40 for pressure connection 44 fastened there. However, it is also possible for transverse bore 39 to be made in the form of a blind hole and for partial chamber 42 to be cut off in the vicinity of the end opposite punch head 40 from a pressure channel running axially in the lance. When the pressure is released, ejector punch 38 is driven backward by compression spring 45 from hollow shape 5 into bore 39.

The arrangement of ejector punch 38 can be any angular position; in addition, a plurality of ejector punches 38 can be provided parallel to one another or offset from one another by a specific angular position in a lance. It is also possible for the lance to have only a single ejector punch 38. For ejecting a plurality of slugs 26 from the same hollow shape 5, the lance must be advanced axially by a certain amount or, if the slugs are at different angular positions with respect to one another, must be rotated by the specified amount. For this purpose, the lance is located within hollow shape 5 and axially with respect to the latter and spaced away from the latter in such fashion that with ejector punch 38 retracted within hollow shape 5, it can be rotated around its axis to push out a plurality of slugs 26 in the circumferential direction of hollow shape 5, said slugs being offset by an angle from one another in holes 29. Hollow shape 5 itself can be clamped in a fixed position or can be in a mold that has openings at suitable points for ejecting slugs 26. The slugs can be removed for example during the process for testing hollow shapes 5 during quality testing to check the holes.

Particularly in the case of bent hollow shapes 5 and hollow shapes 5 with small cross sections in which such devices cannot be inserted, as well as in all other designs of hollow shape 5, it is possible to press slugs 26 into interior 27 of the hollow shape after the hollow shape has been removed and then to remove slugs 26 from this interior chamber 27 by flushing it with a flushing liquid. As a result of the location of punch 7, 36 relative to the position of hollow shape 5 within mold 1 and by the retraction function of plunger 13 for slugs 26, in simple fashion one or more slugs 26 can be prevented from falling undetected into mold 1 or being left in hollow shape 5 after being removed at considerable effort from mold 1. Simple removal of slugs 26 is a basic requirement for trouble-free economical automation of the manufacturing of perforated hollow shapes 5.

The method according to the invention for removing slugs 26 from mold 1 can be used in all known methods for making holes in hollow shapes that are based on the action of a high fluid pressure. In this connection, manufacturing methods are also included in which the slug is separated from the outside to the inside from the wall of the hollow shape as well as manufacturing methods in is which this separation takes place from the inside to the outside.

In the case of perforation from the outside to the inside for example, a lance can be introduced into the hollow shape that abuts the hollow shape in a press fit. The hollow shape itself is surrounded by fluid at high pressure. In the lance, a punch is guided in a radial transverse bore, said punch being retracted into the transverse bore when a high fluid pressure is applied within the mold. Then, at the opening that then forms in the transverse bore, the material of the hollow shape is forced into the latter, whereupon this material, after exceeding its ability to expand, tears in the vicinity of the edge of the opening of the transverse bore. Tearing can be assisted by designing the edge of the opening as a cutting edge, with a hole being obtained that has a smoother hole wall. The resultant slug is forced back by the punch into the wall of the hollow profile and jams there. When the pressure fluid drains away, the lance can be removed with or without the hollow shape from the mold. If it is removed along with the hollow shape, since the position of the lance remains unchanged with respect to the hollow shape, the slug can be pushed out of the hole in a simple labor-saving manner outside the mold by again impacting the respective slug by means of the punch that is extended further than during the jamming. If the lance is removed separately from the mold, for removal of the hollow shape and for freeing of the slug, additional slightly more troublesome method steps are required. If the slug is produced at an angle between 0 and 180 degrees relative to a horizontal central parting plane of the hollow shape, it is possible for the slug in upper half 2 not necessarily to be jammed in the wall of the hollow shape. Because the slug within this angle range cannot drop into the mold, the slug remains in the lance and can be removed with the latter until the pressure drops in the mold and the pressure fluid is drained away, under control, in simple fashion from the mold.

Perforation can be performed in a different way, by using a stamping punch that acts from the outside on the hollow shape placed in the impression. In order for the slug not to drop into the interior of the hollow shape because of the pressure drop that occurs during perforation, a pressure pad is useful, placed in the hollow shape, said pad pushing the slug, which is not yet completely free of the hole, back into the hole.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for producing a hole in a hollow shape formed in an internal high pressure mold, said mold including an impression corresponding to an exterior surface of said hollow shape, said mold defining a guide bore extending from said impression, a punch being displaceably arranged in said guide bore, said method comprising the steps of:

engaging said punch with an exterior surface of said hollow shape during admission of a high fluid pressure to an interior of said hollow shape such that a thin area is formed in said hollow shape at a perimeter of said punch;

retracting said punch into said guide bore such that a slug of said hollow shape defined by said thin area at least partially tears away from a remaining portion of said hollow shape to at least partially form said hole; and advancing said punch toward said hollow shape to jam said slug into said hole.

2. A method according to claim 1, further comprising the steps of:

removing the hollow shape from the mold; and separating said slug from the remaining portion of said hollow shape.

3. A method according to claim 1, wherein said punch is an embossing punch, such that in said engaging step said thin area is formed by embossing.

4. A method according to claim 1, wherein said punch is a cutting punch, such that in said engaging step said thin area is formed by cutting.

5. A method according to claim 1, wherein an end of said punch facing said hollow shape defines a cavity, such that during an initial portion of said engaging step, said hollow shape is forced into said cavity by said high fluid pressure.

6. A method according to claim 5, wherein during a subsequent portion of said engaging step, said punch is displaced toward the hollow shape such that a cutter of said punch cuts into a wall of the hollow shape.

7. A method according to claim 1, wherein said punch defines an axial bore, said punch including a plunger arranged axially movably in said axial bore, said advancing step being effected via said plunger.

8. A method according to claim 7, wherein said plunger is coupled to a compression spring, such that during said engaging step said plunger acts as a pressure pad supporting a portion of said hollow shape inside said perimeter of the punch.

9. A mold having a device for producing a hole in a hollow shape formed by internal high pressure forming, comprising:

an internal high pressure mold including an impression corresponding to an exterior surface of said hollow shape, said mold defining a guide bore extending from said impression;

a punch displaceably arranged in said guide bore;

means for engaging said punch with an exterior surface of said hollow shape during admission of a high fluid pressure to an interior of said hollow shape such that a thin area is formed in said hollow shape at a perimeter of said punch;

means for retracting said punch into said guide bore such that a slug of said hollow shape defined by said thin area at least partially tears away from a remaining portion of said hollow shape to at least partially form said hole; and means for advancing said punch toward said hollow shape to jam said slug into said hole.

10. A device according to claim 9, further comprising:

means for removing the hollow shape from the mold; and means for separating said slug from the remaining portion of said hollow shape.

11. A device according to claim 9, wherein an end of said punch facing said hollow shape defines a cavity.

12. A device according to claim 9, wherein said punch defines an axial bore, said punch including a plunger arranged axially movably in said axial bore, said plunger being said means for advancing.

13. A device according to claim 12, wherein said plunger is coupled to a compression spring.

14. A mold having a device for producing a hole in a hollow shape formed by internal high pressure forming, comprising:

an internal high pressure mold including an impression corresponding to an exterior surface of said hollow shape, said mold defining a guide bore extending from said impression; and a punch displaceably arranged in said guide bore, said punch defining an axial bore, said punch including a plunger arranged axially movably in said axial bore.

15. A device according to claim 14, wherein said punch is an embossing punch.

16. A device according to claim 14, wherein said punch is a cutting punch.

17. A device according to claim 14, wherein an end of said punch facing said impression defines a cavity.

18. A device according to claim 14, wherein an end of said plunger facing away from said impression is coupled to a compression spring.

19. A device according to claim 14, further comprising an ejector punch.

* * * * *